US007303029B2

(12) United States Patent
Hall et al.

(10) Patent No.: US 7,303,029 B2
(45) Date of Patent: Dec. 4, 2007

(54) FILTER FOR A DRILL STRING

(75) Inventors: David R. Hall, Provo, UT (US); David S. Pixton, Lehi, UT (US); Michael Briscoe, Lehi, UT (US); James McPherson, Sandy, UT (US)

(73) Assignee: IntelliServ, Inc., Provo, UT (US)

( * ) Notice: Subject to any disclaimer, the term of this patent is extended or adjusted under 35 U.S.C. 154(b) by 161 days.

(21) Appl. No.: 10/711,596

(22) Filed: Sep. 28, 2004

(65) Prior Publication Data

US 2006/0065444 A1 Mar. 30, 2006

(51) Int. Cl.
*E21B 43/34* (2006.01)

(52) U.S. Cl. ..... 175/314; 166/65.1

(58) Field of Classification Search ..... 175/314; 166/65.1

See application file for complete search history.

(56) References Cited

U.S. PATENT DOCUMENTS

| | | | | |
|---|---|---|---|---|
| 2,414,719 | A | 1/1947 | Cloud | |
| 3,518,608 | A | 6/1970 | Papadopoulos | |
| 4,495,073 | A | 1/1985 | Beimgraben | |
| 4,739,325 | A | 4/1988 | MacLeod | |
| 4,788,544 | A | 11/1988 | Howard | |
| 6,012,015 | A | 1/2000 | Tubel | |
| 6,252,518 | B1 | 6/2001 | Laborde | |
| 6,392,317 | B1 | 5/2002 | Hall et al. | |
| 6,589,685 | B2 | 7/2003 | Mizuno et al. | |
| 6,670,880 | B1 | 12/2003 | Hall et al. | |
| 6,684,951 | B2 * | 2/2004 | Restarick et al. | 166/250.01 |
| 6,688,396 | B2 | 2/2004 | Floerke et al. | |
| 6,717,501 | B2 | 4/2004 | Hall et al. | |
| 6,799,632 | B2 | 10/2004 | Hall et al. | |
| 6,821,147 | B1 | 11/2004 | Hall et al. | |
| 6,830,467 | B2 | 12/2004 | Hall et al. | |
| 6,844,498 | B2 | 1/2005 | Hall et al. | |
| 6,866,306 | B2 | 3/2005 | Boyle et al. | |
| 6,888,473 | B1 | 5/2005 | Hall et al. | |
| 6,913,093 | B2 | 7/2005 | Hall et al. | |
| 6,929,493 | B2 | 8/2005 | Hall et al. | |
| 6,945,802 | B2 | 9/2005 | Hall et al. | |
| 6,968,611 | B2 | 11/2005 | Hall et al. | |
| 2004/0039466 | A1 | 2/2004 | Lilly et al. | |
| 2004/0104797 | A1 | 6/2004 | Hall et al. | |
| 2004/0113808 | A1 | 6/2004 | Hall et al. | |
| 2004/0145492 | A1 | 7/2004 | Hall et al. | |

(Continued)

OTHER PUBLICATIONS

PCT/US03/16475, Published Dec. 4, 2003, Applicant Baker Hughes; International Search Report: "Documents Considered to Be Relevant".

*Primary Examiner*—David Bagnell
*Assistant Examiner*—Nicole A Coy
(74) *Attorney, Agent, or Firm*—Tyson J. Wilde; Jeffery E. Daly

(57) ABSTRACT

A filter for a drill string comprises a perforated receptacle having an open end and a perforated end and first and second mounting surfaces are adjacent the open end. A transmission element is disposed within each of the first and second mounting surfaces. A capacitor may modify electrical characteristics of an LC circuit that comprises the transmission elements. The respective transmission elements are in communication with each other and with a transmission network integrated into the drill string. The transmission elements may be inductive couplers, direct electrical contacts, or optical couplers. In some embodiments of the present invention, the filter comprises an electronic component. The electronic component may be selected from the group consisting of a sensor, a router, a power source, a clock source, a repeater, and an amplifier.

19 Claims, 6 Drawing Sheets

U.S. PATENT DOCUMENTS

2004/0150532 A1 8/2004 Hall et al.
2004/0164833 A1 8/2004 Hall et al.
2004/0164838 A1 8/2004 Hall et al.
2004/0216847 A1 11/2004 Hall et al.
2004/0244916 A1 12/2004 Hall et al.
2004/0244964 A1 12/2004 Hall et al.
2004/0246142 A1 12/2004 Hall et al.
2005/0001735 A1 1/2005 Hall et al.
2005/0001736 A1 1/2005 Hall et al.
2005/0001738 A1 1/2005 Hall et al.
2005/0035874 A1 2/2005 Hall et al.
2005/0035875 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0045590 A1 3/2005 Hall et al.
2005/0046586 A1 3/2005 Hall et al.
2005/0067159 A1 3/2005 Hall et al.
2005/0070144 A1 3/2005 Hall et al.
2005/0082092 A1 4/2005 Hall et al.
2005/0092499 A1 5/2005 Hall et al.
2005/0093296 A1 5/2005 Hall et al.
2005/0095827 A1 5/2005 Hall et al.
2005/0115717 A1 6/2005 Hall et al.
2005/0145408 A1 7/2005 Hall et al.
2005/0150853 A1 7/2005 Hall et al.
2005/0161216 A1 7/2005 Hall et al.
2005/0173126 A1 8/2005 Hall et al.
2005/0212530 A1 9/2005 Hall et al.
2005/0236160 A1 10/2005 Hall et al.
2005/0279508 A1 12/2005 Hall et al.
2005/0284662 A1 12/2005 Hall et al.
2005/0284663 A1 12/2005 Hall et al.
2005/0284859 A1 12/2005 Hall et al.
2005/0285645 A1 12/2005 Hall et al.
2005/0285705 A1 12/2005 Hall et al.
2005/0285706 A1 12/2005 Hall et al.
2005/0285751 A1 12/2005 Hall et al.
2005/0285752 A1 12/2005 Hall et al.
2005/0285754 A1 12/2005 Hall et al.

* cited by examiner

FILTER FOR A DRILL STRING

FEDERAL SPONSORSHIP

This invention was made with government support under Contract No. DE-FC26-01NT41229 awarded by the U.S. Department of Energy. The government has certain rights in the invention.

BACKGROUND OF THE INVENTION

As drilling mud is recirculated during drilling, debris from earth formations may damage sensitive downhole equipment. Filters used to collect the debris and thereby provide a way of removing the debris are known in the art. Often these filters will attach in single shouldered pipe such as described in U.S. Pat. No. 4,495,073. The '073 patent discloses a mud screen for installation between any two selected ends of interconnected pipes comprising a supporting collar anchored in the selected threaded connection of the drill pipe string and a screen support mounted on such collar and secured thereto by one or more releasing devices. An apertured inverted conical screen is supported by the screen support in transverse relationship to the pipe bore. A bridging element is secured across the screen support and defines a mounting for an upstanding post which functions as a manual handle and also defines a fishing neck at its upper end for downhole retrieval.

U.S. Pat. No. 6,598,685 discloses another system for mounting a filter in a drill string. Disclosed is an apparatus comprising a cylindrical flange member having a first and second passage and a cylindrical sleeve having an internal fishing neck. An attachment pin attaches the flange member to the cylindrical sleeve. The apparatus further comprises a screen member attached to the cylindrical sleeve. In one embodiment, the first and second passages are disposed off-centered so that four bore holes are created. The attachment pin cooperates with a groove formed on the sleeve's outer diameter surface. The apparatus may further include a pulling tool. The pulling tool contains a plurality of dog members disposed about the mandrel, and a spring that urges the dog members into engagement with a protuberance on the mandrel. The apparatus further comprises a shear pin attaching the dog members to the mandrel and wherein the shear pin is disposed within a slot so that the dog members can move axially relative to the mandrel.

Data transmission systems integrated into a drill string may utilize some of the sensitive equipment downhole that may be damaged by the debris. Some of these transmission systems utilize double shoulder pipe which may exclude the references above as being compatible with their systems. Such systems are disclosed in U.S. Pat. No. 6,670,880 to Hall, et al.; 6,641,434 to Boyle, et al.; and 6,688,396 to Floerke, et al. which are all herein incorporated by reference.

BRIEF SUMMARY OF THE INVENTION

A filter for a drill string comprises a perforated receptacle having an open end and a perforated end and first and second mounting surfaces are adjacent the open end. Data transmission elements are disposed within each of the first and second mounting surfaces. The respective transmission elements are in communication with each other and with a transmission network integrated into the drill string.

Also disclosed is a filter for a drill string comprising a perforated, corrosion-resistant receptacle having an open end and a perforated end. First and second mounting surfaces are adjacent the open end and data transmission elements are disposed within a groove in each of the first and second mounting surfaces. The respective transmission elements are in communication with each other via an electrical conductor and with a transmission network integrated into the drill string. The perforated receptacle may comprise a cylindrical shape, a conical shape, a rectangular shape, a spherical shape, or an amorphous shape.

The data transmission elements and the electrical conductor may form an LC circuit with a characteristic impedance. The transmission elements of the filter may transceive data from an integrated network which comprises a characteristic impedance different from the impedance of the filter's LC circuit. Disclosed is a capacitor that may modify the impedance of the LC circuit and reduce electromagnetic reflections that may result from mismatched impedances.

Grooves which house the transmission elements may comprise a biasing element adapted to bias the transmission elements towards adjacent transmission elements; thereby reducing the size of or eliminating gaps between the elements. The adjacent transmission elements may be located in adjacent tools of the drill string. Gaps between the transmission elements may result in an attenuated or weakened signal. The mounting surface may further comprise a passageway intersecting the grooves and in fluid communication with the open end of the filter. This may be advantageous because fluid or lubricants may collect in the grooves while installing the filter into the drill string. A passageway may allow the pressure that the lubricants or fluid may exert on the transmission elements to escape to the open end of the filter and into the central bore of the drill string; thereby, reducing pressure on the transmission elements which may cause the transmission elements to fail.

The transmission elements may be inductive couplers, direct electrical contacts, or optical couplers. In some embodiments of the present invention, the filter comprises electronic components. The electronic components may be selected from the group consisting of sensors, routers, power sources, clock sources, repeaters, and amplifiers. Sensors such as fluid pressure and fluid flow rate may provide valuable information to drilling conditions and also the condition of the filter.

The filter may further comprise a mandrel mounted coaxially within the central bore of the drill pipe and adapted for removing or installing the filter. When a filter is retrieved the perforated receptacle may comprise heavy debris and rig equipment may be required to pull the filter out. The mandrel may comprise a hook to interface with the rig equipment.

DETAILED DESCRIPTION OF THE INVENTION AND THE PREFERRED EMBODIMENT

Figure 1:
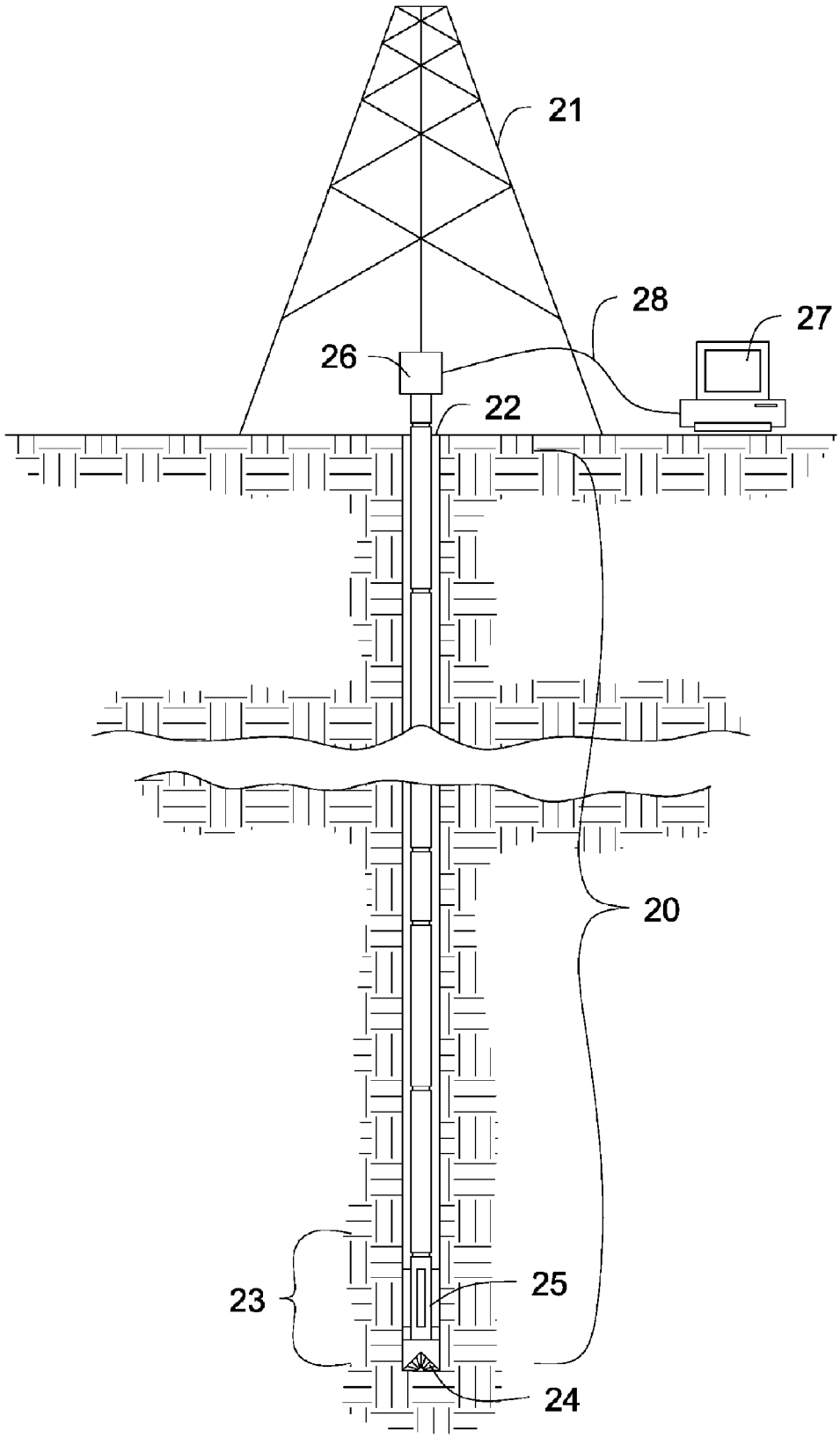
FIG. 1 is a perspective view of a drill string adapted with a downhole network.

FIG. 1 is a perspective view of a drill string 20 incorporating a downhole network. A derrick 21 suspends the drill string 20 within a bore 22 in the earth. A bottom hole assembly 23 of the drill string 20 may comprise drill bits 24 and other equipment such as motors, turbines, jars, mud hammers, fishing tools, steering elements, reamers, drill collars, stabilizers, and etc. which may aid in advancing the drill string 20 deeper into the earth. Furthermore, the bottom-hole assembly 23 may comprise electronic equipment 25 that may be sensitive to downhole debris circulating through the drill string 20. The electronic equipment 25 may also be distributed along the length of the drill string 20. Such electronic equipment 25 may comprise signal filtering circuitry, signal error checking circuitry, device control circuitry, modems, digital processors, optical regenerators, optical transmitters, optical receivers, repeater circuits, sensors, routers, switches, memory, amplifiers, data compression circuitry, data rate adjustment circuitry, wireless transceivers, digital/optical converters, analog/optical converters, and microcontrollers.

A preferred system for transmitting data through a drill string 20 is disclosed in U.S. Pat. No. 6,670,880 to Hall et al. A swivel assembly 26 may be located at the top of the drill string 20 which may act as a physical interface to the derrick 21 and may provide a means 28 for transmitting data to and from surface equipment 27, such as a computer. One embodiment of a downhole network consistent with the present invention is disclosed in U.S. patent application Ser. No. 10/710,790 entitled "Distributed Downhole Network," and filed on Aug. 3, 2004 in the name of Hall, et al.

Figure 2:
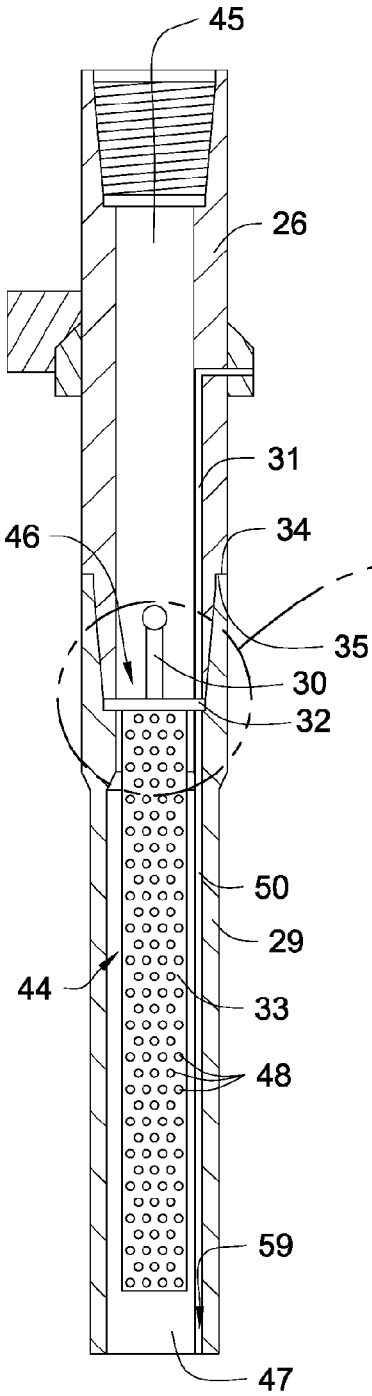
FIG. 2 is a cross sectional view of a drill string comprising a mounted filter.

FIG. 2 shows a cross section of an embodiment of a drill pipe 29 attached to the swivel assembly 26. A filter 44 is mounted within the central bore 45 of the drill string 20. The filter 44 comprises a mandrel 30 mounted normal to a flange 32. A perforated receptacle 33 is mechanically attached to the flange 32. The flange 32 is open providing the filter 44 with an open end 46. The receptacle 33 also comprises a perforated end 47, which collects debris. Large pieces of debris may enter the filter 44 through the open end 46, but large pieces will collect in the perforated end 47 of the receptacle 33, while allowing drilling mud and smaller pieces of debris to flow through perforations 48 in the receptacle 33. A first conductor 31 runs through the swivel assembly 26 and a second conductor 50 runs through the drill pipe 29. The conductors 31, 50 may be coaxial cables, triaxial cables, twin axial cables, shielded twin axial cables, pairs of twisted wires, shielded pairs of twisted wires, or optical cables. In other embodiments of the present invention, the filter 44 may be mounted between drill pipes 29, drill collars, and other downhole tools, or combinations thereof. The primary shoulder 34 of the swivel 26 and the primary shoulder 35 form a mechanical seal.

The second conductor 50 is part of the transmission network 59. A preferred transmission network is disclosed in U.S. application Ser. No. 10/710,790, filed on Aug. 3, 2004; which is herein incorporated by reference.

Preferably, the perforated receptacle 33 is corrosion resistant. An electrically insulating polymer may coat the outer surface of the receptacle 33 to protect it from corrosive material that may be circulating through the drill string 20. Further, an electrically insulating polymer, such as polyurethane or Teflon® may help prevent against galvanic corrosion. In other embodiments fiberglass or metal alloys, such as chromium steel, may be used to prevent against corrosion.

More than one filter 44 may be mounted in the drill string 20. Multiple filters 44 may prove to be advantageous by filtering more debris from the circulating mud. The top-most filter 44 may filter most of the debris, while the downhole filters 44 may function as backup filters 44 and catch significantly less debris. However, the downhole filters may require retrieval for empting the filters 44 less frequently. A downhole filter 44 may be placed immediately above the sensitive equipment 25 and therefore increase the protection to that equipment 25. An advantage to mounting the filter 44 immediately below the swivel assembly 26 is that of easy removal. A typical segment of drill pipe added to a drill string 20 during tripping may have a length of ninety feet. After the drill string 20 advances into the earth ninety feet, the filter 44 may be full. The filter 44 may be retrieved and replaced or cleaned before more drill pipe 29 is added to the drill string 20.

Figure 3:
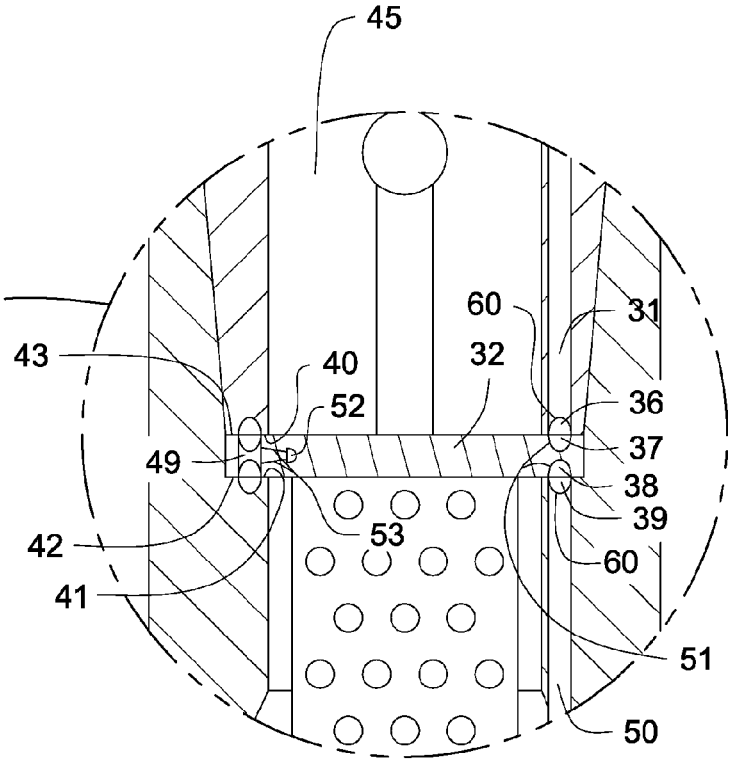
FIG. 3 is a detailed view of a portion of the filter as shown in FIG. 2.

FIG. 3 is a detailed view of a portion of the filter as shown in FIG. 2. The flange 32 of the filter 44 comprises first and second mounting surfaces 40, 41. The first and second mounting surfaces 40, 41 may comprise annular grooves 51 which house respective first and second transmission elements 37, 38. A secondary shoulder 42 of the drill pipe 29 and a secondary shoulder 43 of the swivel assembly 26 also comprise grooves 60 that comprise cooperating transmission elements 36, 39. The transmission elements 36, 37, 38, 39 may be inductive couplers, direct electrical contacts, or optical couplers. A preferred transmission element is disclosed in U.S. Pat. No. 6,670,880 to Hall, et al. Other compatible inductive couplers are disclosed in U.S. Pat. No. 6,641,434 and U.S. application Ser. No. 10/708,793 to Hall, et al. U.S. filed on Mar. 25, 2004, application Ser. No. 10/708,793 is herein incorporated by reference. Compatible direct electrical contacts are described in U.S. Pat. No. 6,688,396 to Floerke, et al. and U.S. application Ser. No. 10/605,493 to Hall et al. filed on Oct. 2, 2003. U.S. application Ser. No. 10/605,493 is herein incorporated by reference.

A third conductor 49 connects the first and second transmission elements 37, 38. The third conductor 49 may be a coaxial cable, a triaxial cable, a twin axial cable, a shielded twin axial cable, a pair of twisted wires, a shielded pair of twisted wires, or an optical cable. Preferably the impedance of the first and second conductors 31, 50 match the impedance of the third conductor 49 located in the flange 32 of the filter 44. A coaxial cable's capacitance is dependant upon its length and will therefore affect its impendence. The length of the third conductor 49 in the flange 32 may be a different length than the other conductors 31, 50 resulting in mismatched impedance. A capacitor 52 may alter the capacitance of the third conductor 49. The capacitor 52 may be configured as shown in FIG. 3 with lead wires 53 electrically connected to the third conductor 49. A configuration of a coaxial capacitor 52, which may be compatible with the present invention, is disclosed in U.S. application Ser. No. 10/878,242, filed on Jun. 28, 2004 to Hall, et al, which is herein incorporated by reference.

Still referring to FIG. 3, the mounting surface 41 of the flange 32 rests on the secondary shoulder 42 of the drill pipe 29. The secondary shoulder 43 of the swivel assembly 26 rests on the mounting surface 40 of the flange 32. A mechanical seal is formed between the mounting surface 41 and shoulder 42 and between the mounting surface 40 and shoulder 43. Further, a mechanical seal is formed between the primary shoulder 34 (shown in FIG. 2) of the swivel assembly 26 and the primary shoulder 35 (shown in FIG. 2) of the drill pipe 29. In typical double shouldered pipe, the mechanical seal is formed between the secondary shoulders 42, 43. In accordance with the present invention a portion of a pin end of the swivel assembly 26 may be removed such to form a gap appropriate to mount the filter 44 such that mechanical seals may form between the mounting surfaces 40, 41 and the respective shoulders 43, 42 of the swivel assembly 26 and the drill pipe and such that a mechanical seal may form between the primary shoulders 34, 35.

In some drill pipe secondary shoulders do not create a mechanical seal; in such cases the filter 44 may be inserted into the drill pipe without modifying a swivel or other downhole component. Since downhole components not designed to form a mechanical seal between the secondary shoulders of the pipes have a tolerances that may range several inches, a spring adapted to bias the transmission elements 37, 38 in the mounting surfaces 40, 41 to the transmission elements 36, 39 in the adjacent pipes is disclosed. Further biasing elements may include a gas compressed chamber, or elastic material. The filter 44 of the present invention may be adapted to an insert such as described in U.S. application Ser. No. 10/710,639 filed on Jul. 27, 2004; which is herein incorporated by reference; by mechanically attaching the perforated receptacle 33 to the insert.

Figure 4:
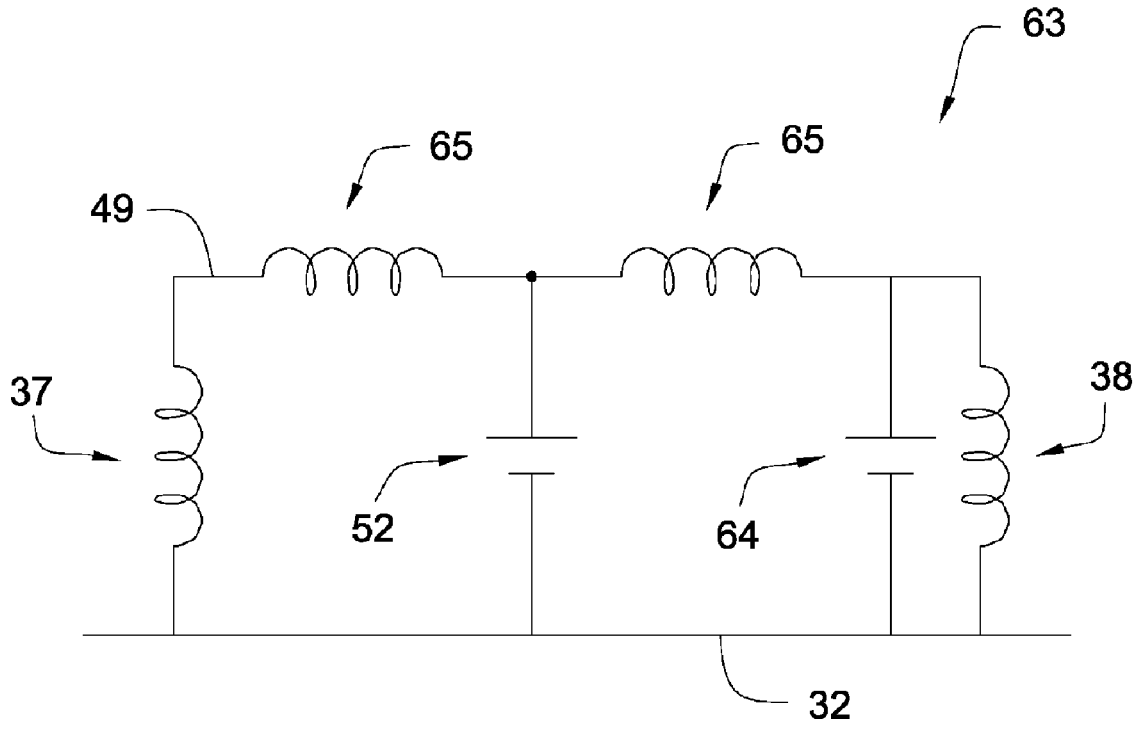
FIG. 4 is a schematic diagram of an LC circuit.

FIG. 4 shows an electrical schematic diagram of an embodiment of a LC circuit 63 formed between transmission elements 37, 38 and the third conductor 49. In this embodiment the transmission elements 37, 38 are inductive couplers. Also in this embodiment, the third conductor 49 is a coaxial cable and therefore has its own intrinsic capacitance 64 and inductance 65. The flange 32 acts as ground. A capacitor 52 is added which changes electrical characteristics of the circuit 63 and may match electrical characteristics, such as impendence, which electrical characteristics of the first conductor 31 of the swivel 26 (shown in FIG. 2) and the second conductor 50 of the downhole component 29 (also shown in FIG. 2) such that signal attenuation is minimized.

Figure 5:
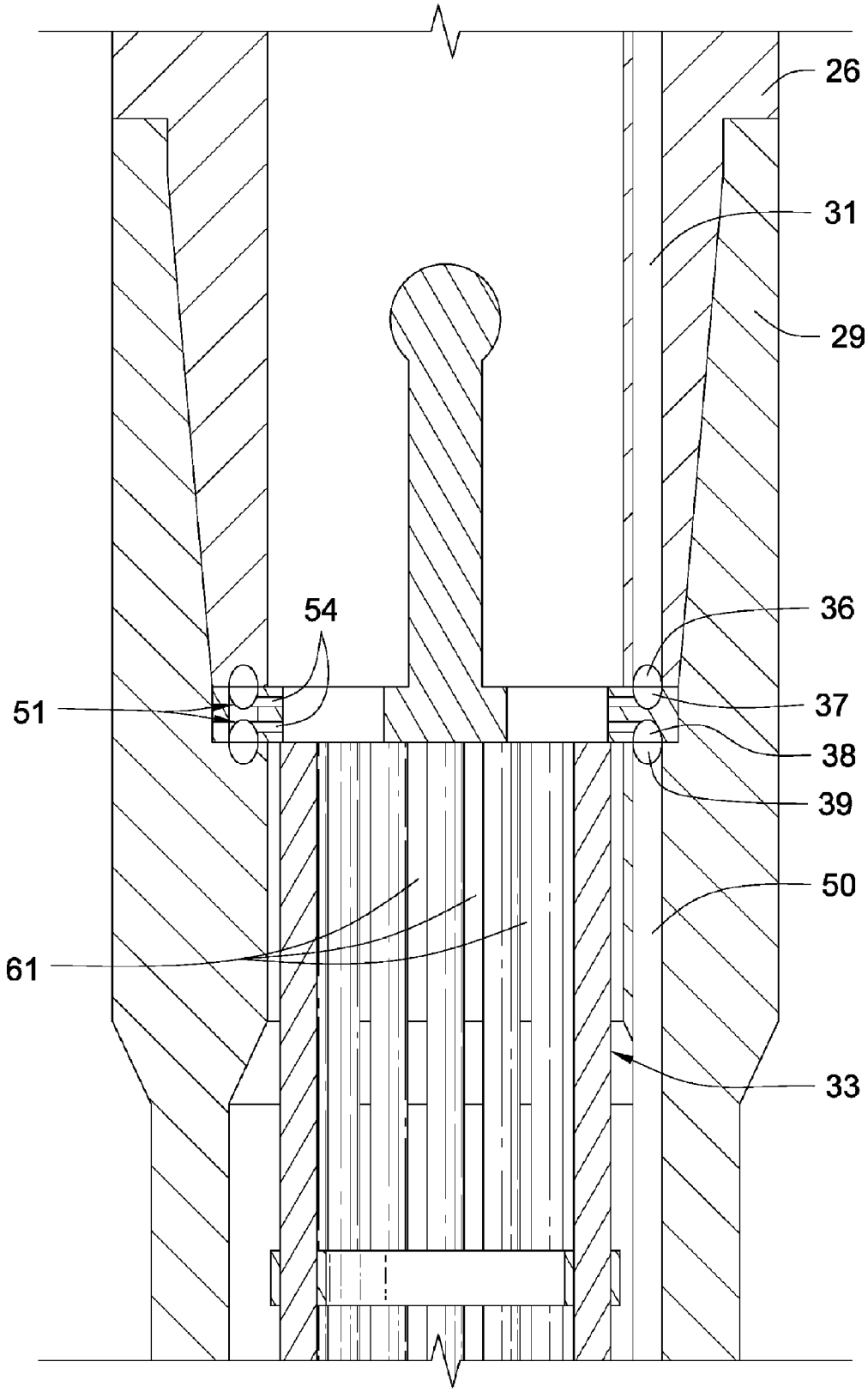
FIG. 5 is a cross sectional view of the filter mounted between drill string components.

FIG. 5 shows passageways 54 intersecting the groove 51 where the transmission elements 37, 38 are disposed. The passageways 54 are also in fluid communication with the open end 46 (shown in FIG. 6) of the filter 44. Passageways 54 may be advantageous because fluid or lubricants may collect in the grooves 51 while installing the filter 44 into the drill string 20. As the downhole components 26, 29 are joined together the lubricants or other fluids may compress within the grooves 51 in the mounting surfaces 40, 43 (shown in FIG. 3). The mechanical seals described earlier may prevent the pressure from escaping and the pressure may damage the transmission elements 37, 38 unless a pressure relief path is present. A passageway 54 may allow the pressure that the lubricants or fluid may exert on the transmission elements 37, 38 to escape to the open end 46 of the filter 44 and into the central bore 45 of the drill string 20; thereby, reducing pressure on the transmission elements 37, 38 which may cause the transmission elements 37, 38 to fail. FIG. 5 further illustrates a perforated receptacle 33 comprising slot perforation 61.

Figure 6:
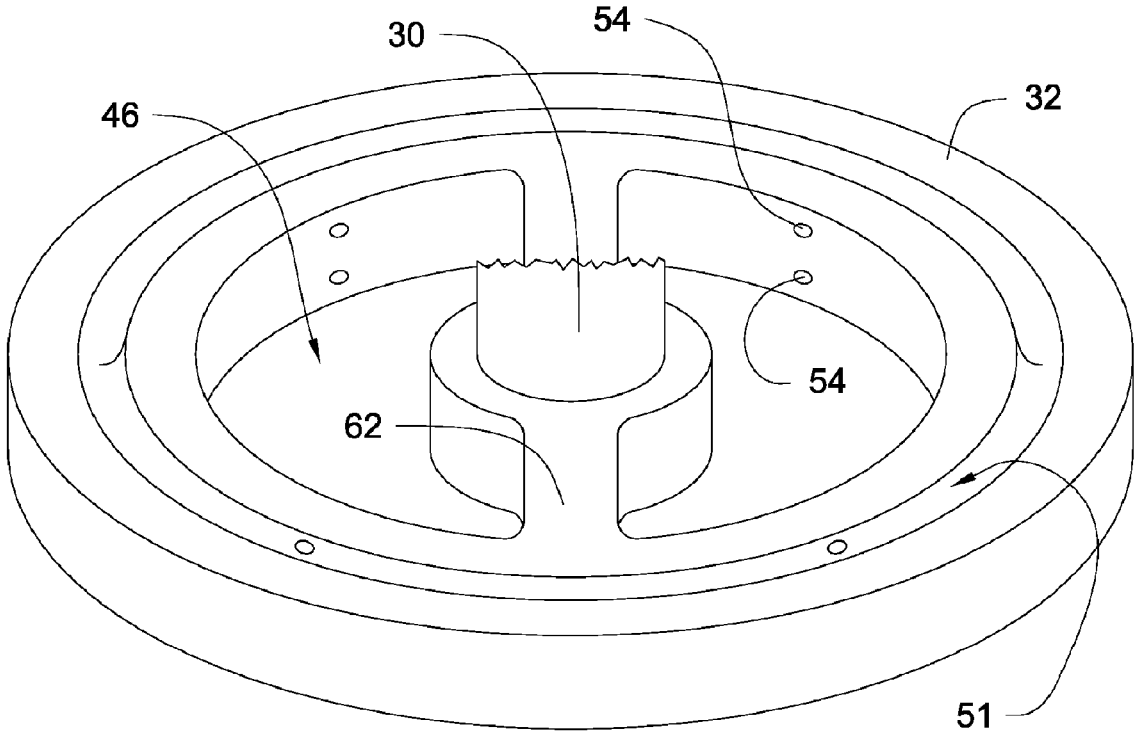
FIG. 6 is a perspective view of a flange of the filter.

FIG. 6 is a perspective view of the flange of the filter. The passageways 54 intersect the grooves 51 such that the open end 46 is in fluid communication with the grooves 51. Fluid may enter the passageways 54 from the groove 51 and exit through the open end 46. U.S. application Ser. No. 10/710,586 filed on Jul. 22, 2004; which is herein incorporated by reference; discloses at least one passageway in the pin end of the downhole component comprising a transmission element Ser. No. 10/710,586 discloses embodiments and advantages associated the passageways. In a preferred embodiment the mandrel 30 is attached to flange 32 by a connecting bridge 62.

Figure 7:
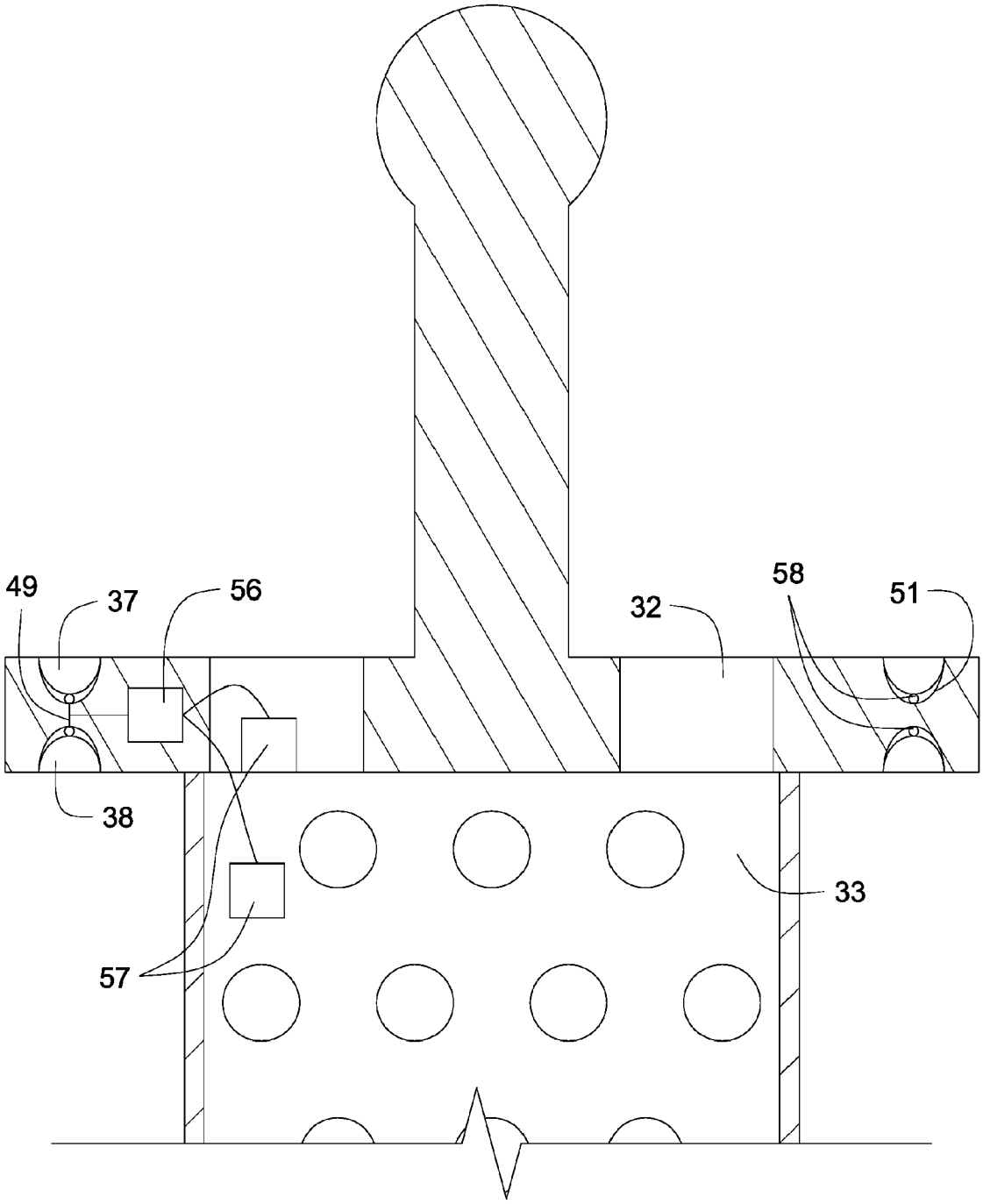
FIG. 7 is a cross sectional view of a portion of the filter.

FIG. 7 is a cross sectional view of a portion of a filter 44. Electronic component 56 may be operably connected to the third conductor 49 located in the flange 32. The electronic component 56 may be selected from the group consisting of sensors, routers, power sources, clock sources, repeaters, and amplifiers. The electronic component 56 may be located internally or externally in the flange 32. Further the electronic component 56 may be fix to the perforated receptacle 33. The component 56 may comprise a processing element, such as a central processing unit in a processor, which may coordinate the activity of several electronic components, such as sensors 57.

Sensors 57 that measure fluid pressure and fluid flow rate may provide valuable information about drilling conditions and also the condition of the filter 44. As the filter 44 collects debris, the debris may block the perforations 48 in the receptacle 33 resulting in fluid traveling through the other perforations 48 of the receptacle 33 with a higher pressure. Sensing this pressure may indicate when the filter 44 has collected enough debris that the flow of fluid through the drill string 20 is impaired so the filter 44 may be replaced. Pressure measured in the central bore 45 of the drill string 20 may be compared with pressure outside of the drill string 20 to indicate if drilling mud is being lost into a formation in the earth. Other types of electronic components 56 may aid in the transmission of a data signal; such component 56 may be selected from the group consisting of signal filtering circuitry, signal error checking circuitry, device control circuitry, modems, digital processors, optical regenerators, optical transmitters, optical receivers, repeater circuits, sensors, routers, switches, memory, amplifiers, data compression circuitry, data rate adjustment circuitry, wireless transceivers, digital/optical converters, analogue/optical converters, and microcontrollers.

Also shown in FIG. 7 are biasing elements 58 located within the groove 51 of the flange 32. Transmission elements 37, 38 may require physical contact to transmission elements 36, 39 (shown in FIG. 3) respectively in adjacent downhole component 26, 29 (shown in FIG. 2) in order for adequate data transmission to occur. Biasing elements 58 may bias transmission elements 37 and 38 out of the grooves 51 to form an intimate contact with transmission elements 36 and 39 respectively. U.S. application Ser. Nos. 10/453,076 filed on Jun. 3, 2003; and Ser. No. 10/612,255 filed on Jul. 2, 2003; both to Hall, et al.; which are all herein incorporated by reference; disclose biasing elements compatible with the present invention.

Whereas the present invention has been described in particular relation to the drawings attached hereto, it should be understood that other and further modifications apart from those shown or suggested herein, may be made within the scope and spirit of the present invention.

What is claimed is:

1. A filter for a drill string, the drill string comprising a plurality of drill pipes and a bottom hole assembly for drilling a borehole into the earth; the filter comprising:

a perforated receptacle having an open end to receive drilling mud during drilling opposite a perforated end a length of a flange extending perpendicularly from an axis of the receptacle and the flange being attached to the receptacle adjacent the open end comprising first and second mounting surfaces;

and a transmission element disposed in each of the first and second mounting surfaces, wherein the respective transmission elements are in electrical communication with each other through an electrically conductive cable disposed within a passageway formed in the flange and with a transmission network integrated into the drill string.

2. The filter of claim 1 wherein each mounting surface comprises a groove which houses the transmission element.

3. The filter of claim 2 wherein at least one of the mounting surfaces comprise a passageway intersecting the groove and in fluid communication with the open end of the filter.

4. The filter of claim 2 wherein at least one of the grooves comprise a biasing element adapted to bias the transmission element towards an adjacent transmission element.

5. The filter of claim 1 wherein the transmission elements are selected from the group consisting of inductive couplers, direct electrical contacts, and optical couplers.

6. The filter of claim 1 wherein the transmission elements are connected by the electrically conductive cable forming a LC circuit.

7. The filter of claim 6 wherein a capacitor modifies electrical characteristics of the LC circuit.

8. The filter of claim 1 wherein the perforated receptacle is corrosion-resistant.

9. The filter of claim 1 wherein the filter further comprises an electronic component.

10. The filter of claim 9 wherein the electronic component is selected from the group consisting of a sensor, a router, a power source, a clock source, a repeater, an electronic processor, an integrated circuit, a network node, and an amplifier.

11. The filter of claim 1 wherein the filter further comprises a mandrel mounted coaxially within a central bore of the drill pipe and adapted for removing the filter.

12. A filter for a drill string, the drill string comprising a plurality of drill pipes and a bottom hole assembly for drilling a borehole into the earth; the filter comprising:

a perforated, corrosive resistant receptacle having an open end to receive drilling mud during drilling opposite a perforated end;

first and second mounting surfaces are formed by a flange, a length of the flange extends perpendicularly from an axis of the receptacle and the mounting surfaces are attached adjacent the open end; and a transmission element disposed within a groove in each of the first and second mounting surfaces, wherein the respective transmission elements are in communication with each other through an electrically conductive cable disposed within a passageway formed in the flange forming an LC circuit and with a transmission network integrated into the drill string.

13. The filter of claim 12 wherein the mounting surfaces comprise a passageway intersecting the groove and in fluid communication with the open end of the filter.

14. The filter of claim 12 wherein the groove comprises a biasing element adapted to bias the transmission elements towards adjacent transmission elements.

15. The filter of claim 12 wherein the transmission elements are selected from the group consisting of inductive couplers, direct electrical contacts, and optical couplers.

16. The filter of claim 12 wherein a capacitor modifies electrical characteristics of the electrically conductive cable.

17. The filter of claim 12 wherein the filter further comprises an electronic component.

18. The filter of claim 17 wherein the electronic circuitry is selected from the group consisting of a sensor, a router, a power source, a clock source, a repeater, an electronic processor, an integrated circuit, a network node, and an amplifier.

19. The filter of claim 12 wherein the filter further comprises a mandrel mounted coaxially within a central bore of the drill pipe and adapted for removing the filter.

* * * * *